United States Patent [19]

Lyons et al.

[11] Patent Number: 4,873,850

[45] Date of Patent: Oct. 17, 1989

[54] ANTI-JAMMING UP DEVICE FOR A DRAWER

[75] Inventors: Dale R. Lyons; Don E. Beam, both of Cambridge, Ohio

[73] Assignee: NCR Corporation, Dayton, Ohio

[21] Appl. No.: 286,410

[22] Filed: Dec. 19, 1988

[51] Int. Cl.[4] ..... E05B 65/46

[52] U.S. Cl. ..... 70/85; 312/333; 70/370

[58] Field of Search ..... 70/85, 86, 87, 370, 70/451; 312/333, 219, 220; 235/1 R, 2, 5, 6, 7 R, 10, 22; 248/27

[56] References Cited

U.S. PATENT DOCUMENTS

| | | | |
|---|---|---|---|
| 1,000,268 | 8/1911 | Jadronja . | |
| 2,017,669 | 10/1935 | Meilink | 70/50 |
| 2,145,314 | 1/1939 | Murtaugh, Jr. | 70/85 |
| 2,836,353 | 5/1958 | Waechter | 235/22 |
| 3,674,360 | 7/1972 | Ratner | 312/222 |
| 3,964,280 | 6/1976 | Kelton | 70/370 |
| 4,492,101 | 1/1985 | Tanaka | 70/370 |
| 4,803,346 | 2/1989 | Lyons et al. | 35/7 R |
| 4,811,579 | 3/1989 | Lyons . | |

*Primary Examiner*—Robert L. Wolfe

*Attorney, Agent, or Firm*—Wilbert Hawk, Jr.; Albert Sessler, Jr.; Elmer Wargo

[57] ABSTRACT

A drawer assembly which prevents a drawer from "jamming up" in a locked position when the drawer is slammed shut while a locking arm associated with a key lock on the drawer is in a locking position. A projection on a retainer clip located on the inside of the front panel of the drawer keeps the locking arm from being bent, and also keeps the drawer from moving to the closed position from which a latching mechanism asociated with the drawer would be placed in a locked position.

6 Claims, 4 Drawing Sheets

ANTI-JAMMING UP DEVICE FOR A DRAWER

BACKGROUND OF THE INVENTION (1) Field of the Invention

This invention relates to a drawer assembly which prevents the drawer from "jamming up" in a locked position when the drawer is slammed shut while a locking arm and key lock associated with the drawer are in a locked position prior to moving the drawer to the closed position.

(2) Background Information

Modern data terminals, like electronic cash registers, for example, have cash drawers associated with them for handling financial transactions with customers. Because the cash drawers contain money or other valuables, it is necessary to provide certain precautionary features with these terminals. One of these familiar features relates to providing the cash drawer with a key lock. The key lock has a locking arm which is moved between locking and unlocking positions by a key inserted in the key lock. The frame of the terminal has an abutment member which has a locking side and a non-locking side. When the drawer is to be closed and locked properly, the drawer is first closed, and then, the key is rotated to move the locking arm to the locking position in which the locking arm engages the locking side of the abutment member to hold the cash drawer in the locked position.

Another one of the precautionary features included with some of the terminals relates to including a latch mechanism coupled between the cash drawer and the frame to the terminal. For example, when the cash drawer is closed properly, the latch mechanism keeps the drawer locked until certain events occur. One of these events relates to actuating a transaction key which indicates that a sale has been made, and cash is to be received from and change made for the customer, for example. When the transaction key is actuated, the latch mechanism is disabled or uncoupled, permitting the cash drawer to be opened. For example, a solenoid is energized to release or disable the latch mechanism when the transaction key is actuated.

Another precautionary feature relates to being able to open the cash drawer when electricity is temporarily discontinued. With no electricity, the solenoid cannot be energized to release the latch mechanism as discussed in the previous paragraph. In this situation, a cash drawer release mechanism, which is operated by the key on the drawer, is used. When the key is rotated to an unlocking position, the locking arm associated with the key lock is used to disable or uncouple the latch mechanism mentioned, permitting the drawer to be opened. One such cash drawer release mechanism is shown in U.S. patent application Ser. No. 125,853 which was filed on Nov. 27, 1987 and which was assigned to the same assignee as the present application.

One of the problems associated with a cash drawer of the type being discussed is that, at times, an operator may inadvertently turn the key in the key lock to put the locking arm in a locking position prior to closing the drawer. This puts the locking arm in a position to contact the non-locking side of the abutment member in the example being discussed. When the cash drawer is slammed towards the closed position, the locking member abuts against the non-locking side of the abutment member, causing the locking member to bend and the drawer to jam up in the locked position. Because the locking member is bent, the key cannot be rotated in the key lock to unlock the drawer. Also, the latch mechanism becomes jammed in a locked condition, requiring a service call by a technician to unjam the drawer.

SUMMARY OF THE INVENTION

The present invention obviates the problem mentioned in that it prevents a drawer from becoming jammed in the locked position when the locking member associated with the key lock is placed in a locking position prior to slamming the cash drawer to a closed position.

The present invention is inexpensive and easy to install in cash drawer mechanisms of the type mentioned.

In a preferred embodiment of the invention, there is provided a drawer assembly comprising:

a frame;

a drawer having a front panel;

mounting means for mounting said drawer for movement between open and closed positions relative to said frame;

a key lock mounted in said drawer, with said key lock having a locking arm moveable between locking and unlocking positions by a key associated with said key lock;

said frame having an abutment member with said abutment member having a locking side and a non-locking side, said abutment member cooperating with said locking arm to lock said drawer in said closed position when said locking arm is moved to said locking position by said key to engage said locking side of said abutment member after said drawer is moved to said closed position;

a latching mechanism coupled between said drawer and said frame for latching said drawer in said closed position when said drawer is moved to said closed position and for unlatching said drawer permitting it to move towards said open position upon at least one predetermined event, with one said predetermined event being the movement of said locking arm from said locking position to said unlocking position; and support means positioned between said front panel and said locking arm to provide support for said locking arm when said locking arm is inadvertently placed in said locking position prior to said drawer being moved to said closed position to thereby prevent bending of said locking arm when contacting said non-locking side of said abutment member and also to prevent said drawer from being moved close enough to said closed position which would cause said latching mechanism to latch said drawer to said frame.

The above advantages, and others, will be more readily understood in connection with the following specification, claims, and drawing.

DESCRIPTION OF THE PREFERRED EMBODIMENT

Figure 1:
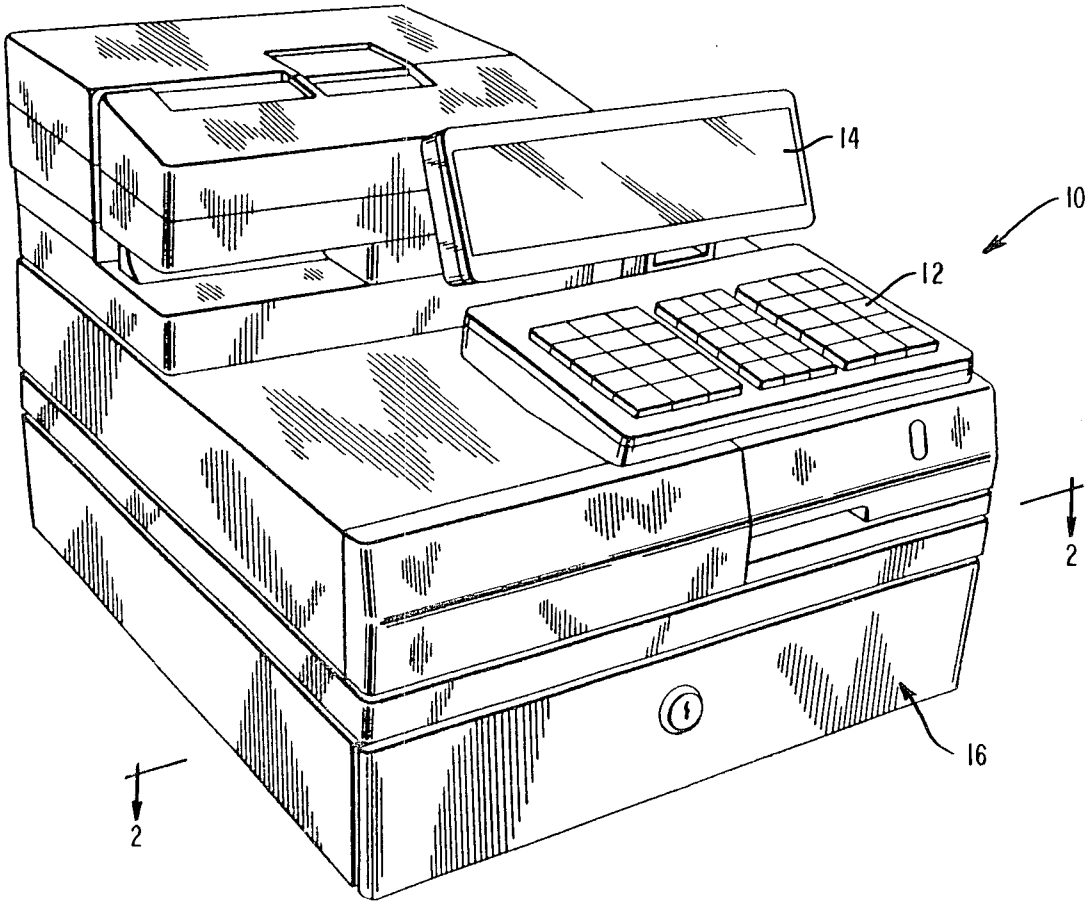
FIG. 1 is a perspective view of a typical data terminal having a cash drawer in which this invention may be used.

FIG. 1 shows a typical transaction terminal 10 in which this invention may be used. The terminal 10 has a keyboard 12 for entering data, a display 14 for indicating various transactions associated with the processing data when using the terminal 10, and a cash drawer 16 for receiving cash or other valuables at the end of a transaction as is typically done. While this invention is discussed in relation to a cash drawer 16, it is apparent that the principles of this invention may be extended to other drawers which are similarly constructed.

Figure 2:
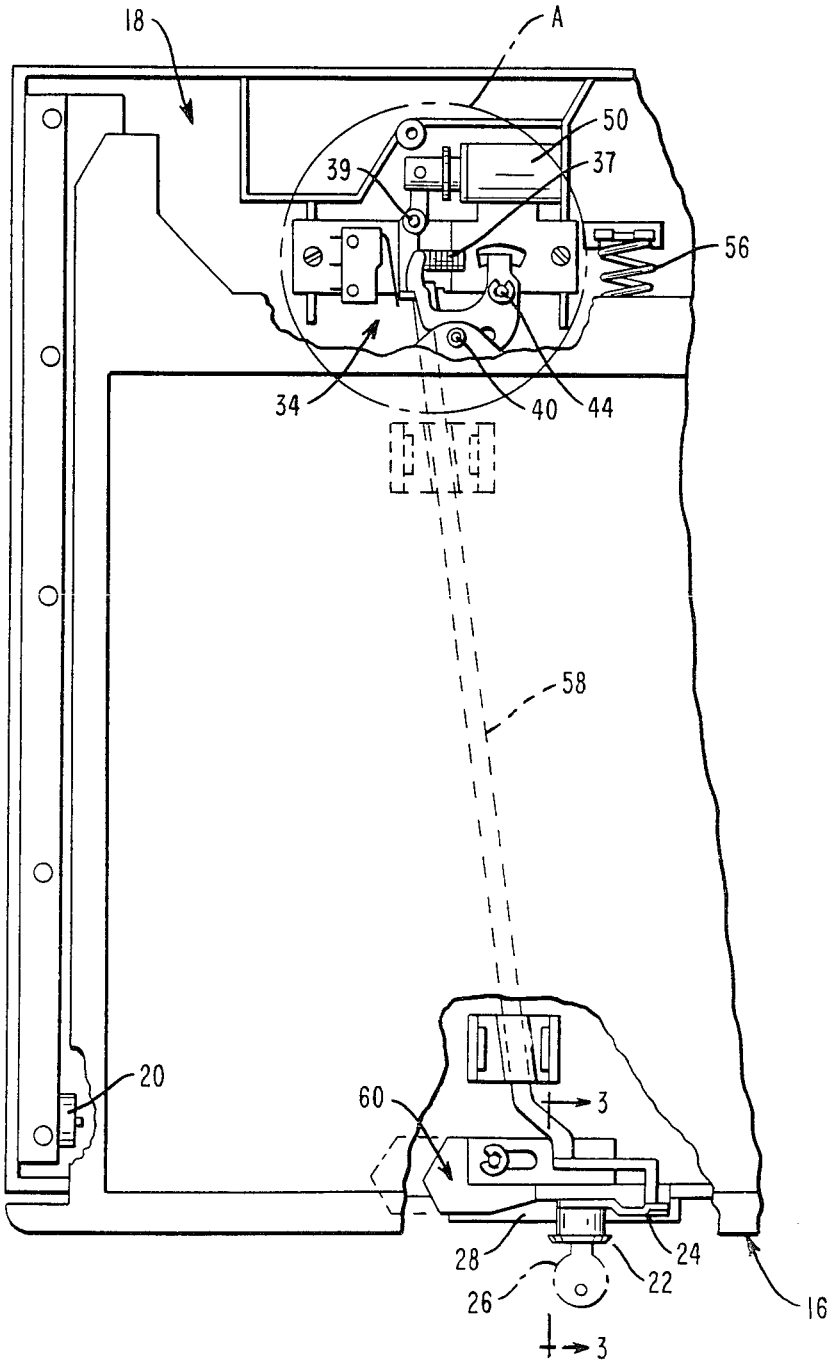
FIG. 2 is a plan view of a portion of the cash drawer mechanism, showing a latch mechanism associated with the drawer, with the latch mechanism included in the dashed circle A being shown in a latched position.

FIG. 2 is a view taken along the line 2—2 of FIG. 1 to show additional details of the cash drawer 16. In this regard, the terminal 10 has a frame 18 and means for mounting the cash drawer 16 for movement between open and closed positions relative to the frame 18. The cash drawer (hereinafter referred to as drawer 16) has rollers, like roller 20, to enable the drawer 16 to slide as described.

The drawer 16 also has a key lock 22 mounted therein as shown in FIG. 2. The key lock 22 has a locking arm 24 which is moveable between the unlocked position shown in FIG. 2 and the locked position shown in FIG. 3 by turning the associated key 26. The frame 18 has an abutment member 28 which cooperates with the locking arm 28 to lock the drawer in the locked position. The abutment member has a locking side 28-1 and a non-locking side 28-2 shown in FIG. 3.

Figure 3:
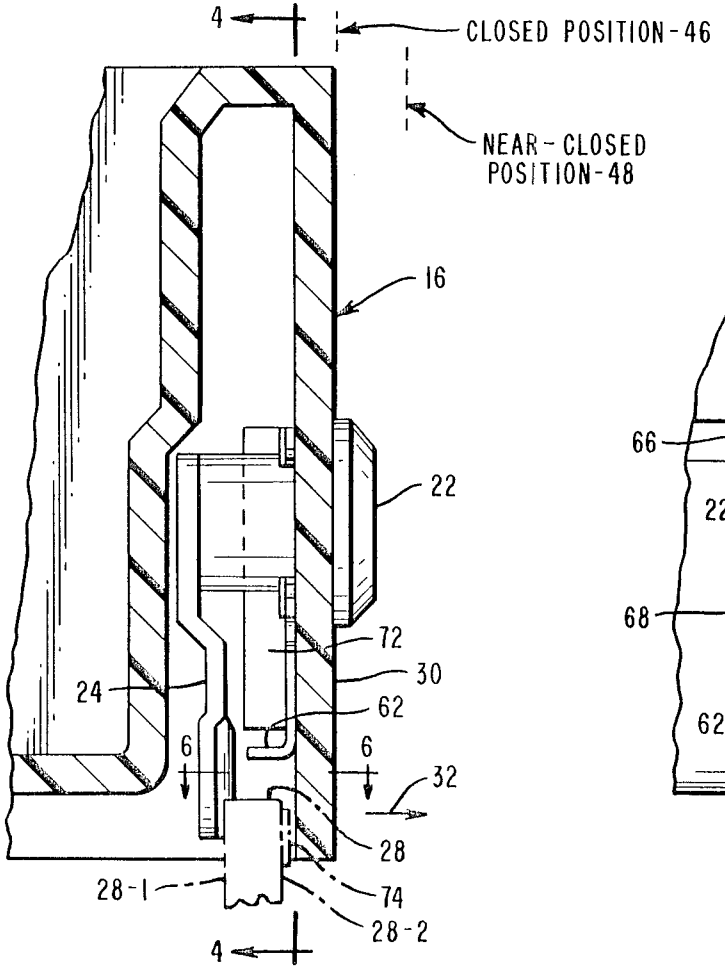
FIG. 3 is a cross-sectional view, taken along the line 3—3 of FIG. 2, to show additional details of the apparatus of this invention.

In normal operation, when one wants to lock the drawer 16, an operator simply closes the drawer 16 to the closed position shown in FIG. 3, and thereafter, the operator turns the key 26 so that the locking arm 24 moves behind the locking side 28-1 of the abutment member 28 as shown. The problem alluded to in the Background Of The Invention occurs when an operator turns the key 26 to rotate the locking arm 24 into the locking position shown in FIG. 3 prior to moving the drawer 16 to the closed position. When this occurs, and the operator slams the drawer 16 to the closed position shown in FIG. 3, the locking arm 24 abuts against the non-locking side 28-2 of the abutment member 28. The inertia of the drawer 16 in being moved to the closed position causes the locking arm 24 to be bent towards the front panel 30 of the drawer 16 prior to this invention. To some degree, the front panel 30 may also be bent outwardly as shown by arrow 32 in FIG. 3. This action causes the drawer 16 to jam up in the locked position, and it requires a service man to unjam the drawer 16.

Figure 5:
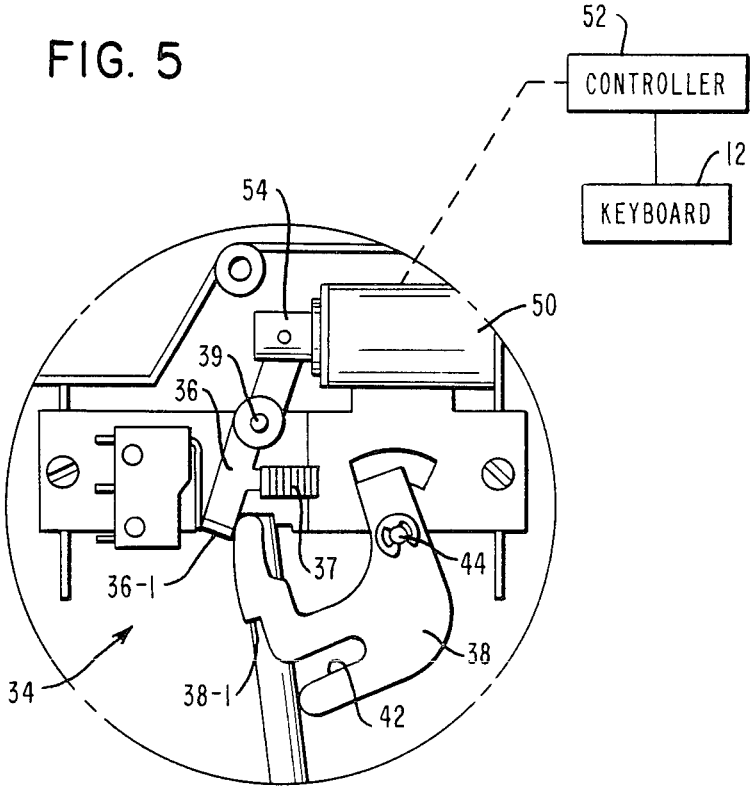
FIG. 5 is a view similar to FIG. 4, showing the latch mechanism included in the dashed circle A in FIG. 2 in an unlatched position.

Part of the jam up of the drawer 16 may be due to a latch mechanism included in the terminal 10. For example, FIG. 2 shows a latch mechanism 34 which is in the latched position to keep the drawer 16 locked until one of certain events occurs. FIG. 5 shows the same latch mechanism 34 in the unlatched position which occurs when the drawer 16 is open. When the latch mechanism 34 is in the unlatched position shown in FIG. 5, a blocking member 36 is pivoted so that a detent 36-1 on the blocking member 36 is out of position relative to an abutment shoulder 38-1 on a pivotally mounted latch member 38. When the drawer 16 is pushed towards the closed position in a routine operation, a pin 40 (FIG. 2) on the rear or inside end of the drawer 16 engages an arcuately-shaped shaped slot 42 on the latch member 38, causing the latch member 38 to rotate in a clockwise direction (as viewed in FIG. 5) about pin 44. When the drawer 16 reaches the closed position 46 as shown in FIG. 3 from the near-closed position 48, the latch member 38 will have rotated sufficiently to enable the detent 36-1 on the blocking member 36 to engage the abutment shoulder 38-1 to thereby hold the drawer 16 in the latched position shown in FIG. 2. A tension spring 37 resiliently biases the blocking member 36 to rotate about pin 39 in a counter-clockwise direction.

One of the events which will release the latch mechanism 34 relates to the routine operation of pressing a particular transaction key (like Total, for example) on the keyboard 12. When this occurs, a solenoid 50 under the control of a controller 52 (shown only diagrammatically in FIG. 5), will be energized causing its operating plunger 54 to be pulled inwardly from the position shown in FIG. 2 to the position shown in FIG. 5. When doing so, the blocking member 36 will be rotated to the position shown in FIG. 5, releasing the abutment shoulder 38-1 on the latch member 38 from the detent 36-1 on the blocking member 36. This permits the drawer 16 to be opened, with the spring 56 (FIG. 2) pushing the drawer 16 to open position.

Another event which will open the drawer 16 relates to the drawer release mechanism disclosed in said copending application mentioned earlier herein. The release mechanism relates to a rotatable rod 58 which cooperates with a moveable block 60 shown in FIG. 2. The release mechanism mentioned permits the latch mechanism 34 to be unlocked to permit the drawer 16 to be opened when the supply of electricity is temporarily cut off. In this regard, the key 26 is rotated to move the block 60 from the position shown in solid outline to the position shown in dashed outline in FIG. 2. As the block 60 moves as described, it causes the rotatable rod 58 to function as a crank which moves the detent 36-1 of the blocking member 36 out of engagement with the abutment shoulder 38-1 on the latch member 38, permitting the latch member 38 to move to the released position shown in FIG. 5. Because the details of the latch mechanism 34 and the release mechanism including the rotatable rod 58 are not important to an understanding of this invention, they need not be discussed in any further detail. Reference may be had to said copending application for additional details of the release mechanism mentioned.

Having described the environment in which this invention may be used, it now seems appropriate to discuss the drawer assembly of this invention. The assembly includes a support means which is positioned between the front panel 30 and the locking arm 24 (FIG. 3) to provide support for the locking arm 24 in the event that the locking arm 24 is inadvertently left in the locking position shown in FIG. 3 prior to having the drawer 16 moved to the closed position shown by line 46. In the embodiment described, the support means takes the form of a projection 62 which is part of a metal lock retainer 64. In other words, the lock retainer 64 is a multi-function part. One function of the lock retainer 64 is performed by the top half (as viewed in FIG. 4) comprising the fingers 66 and 68 being on opposed sides of the recess 70. This top half of the lock retainer 64 performs the usual lock retaining function in that the fingers 66 and 68 pass through mating recesses in the key lock 22 to retain the key lock 22 on the front panel 30 as is conventionally done. The lock retainer 64 has a vertically positioned rib 72 (FIG. 4) to provide rigidity for the lock retainer 64.

Figure 4:
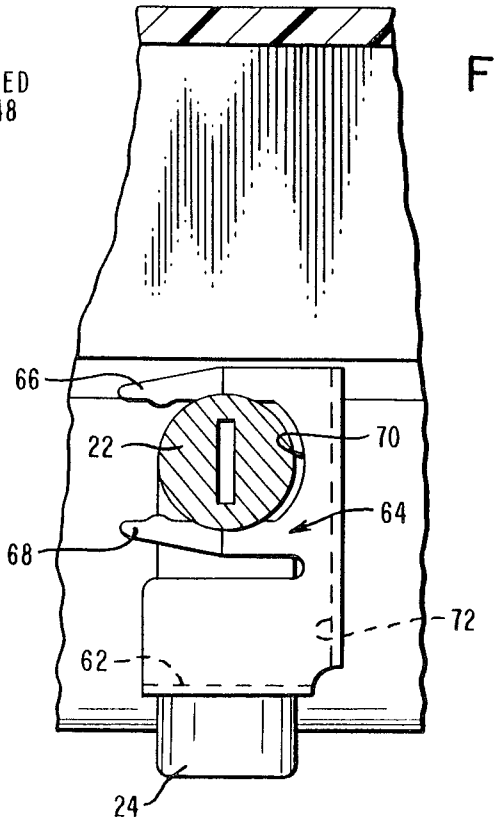
FIG. 4 is a cross-sectional view, taken along the line 4—4 of FIG. 3, to show additional details of a modified lock retainer used in this invention, with several elements eliminated to simplify the showing.

The lower half of the lock retainer 64, as viewed in FIGS. 3 and 4, performs the function of providing support for the locking arm 24 as described. The projection 62 on the lock retainer 64 keeps the locking arm 24 from bending in the direction of arrow 32 towards the front panel 30 of the drawer 16. Because the drawer 16 is made of plastic material in the embodiment described, the front panel 30 would also tend to move in the direction of arrow 32 permitting the locking arm 24 to bend as described with regard to prior art drawers. In effect, the projection 62 keeps the locking arm 24 from bending, and it also keeps the drawer 16 in the near-closed position 48 instead of letting the drawer 16 reach the closed position 46 when the locking arm 24 is in the locking position prior to closing the drawer 16. The lock retainer 64 is positioned next to the front panel 30, and consequently, it tends to distribute the load during slamming of the drawer 16 over the front panel 30 instead of concentrating it at the point of impact with the locking arm 24. Notice that if the drawer 16 reached the closed position 46, the latch member 38 would be rotated as previously described and be retained in the latched position shown in FIG. 2 in cooperation with the blocking member 36 causing the jam up discussed. Because the drawer 16 is not able to reach the closed position 46 FIG. 3), the jam up does not occur.

Figure 6:
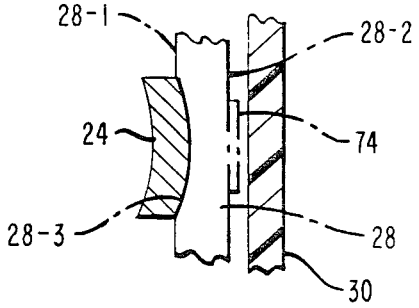
FIG. 6 is a view taken along the line 6—6 of FIG. 3 to show additional enlarged details of an abutment member shown in FIG. 3.

An additional projection 74 located on the non-locking side of the abutment member 28, as shown in FIG. 6, is also used to prevent the drawer 16 from being moved to the closed position shown in FIG. 3 when the locking arm 24 is in the locking position prior to closing the drawer 16. While the projection 74 is shown as a separate member in FIG. 6, it could be integrally formed as part of the abutment member 28. The abutment member 28 also has a slight detent area 28-3 on the locking side 28-1 thereof to receive the locking arm 24 during normal operation.

What is claimed is:

1. A drawer assembly comprising:

a frame;

a drawer having a front panel;

mounting means for mounting said drawer for movement between open and closed positions relative to said frame;

a key lock mounted in said drawer, with said key lock having a locking arm moveable between locking and unlocking positions by a key associated with said key lock;

said frame having an abutment member with said abutment member having a locking side and a non-locking side, said abutment member cooperating with said locking arm to lock said drawer in said closed position when said locking arm is moved to said locking position by said key to engage said locking side of said abutment member after said drawer is moved to said closed position;

a latching mechanism coupled between said drawer and said frame for latching said drawer in said closed position when said drawer is moved to said closed position and for unlatching said drawer permitting it to move towards said open position upon at least one predetermined event, with one said predetermined event being the movement of said locking arm from said locking position to said unlocking position; and support means positioned between said front panel and said locking arm to provide support for said locking arm when said locking arm is inadvertently placed in said locking position prior to said drawer being moved to said closed position to thereby prevent bending of said locking arm when contacting said non-locking side of said abutment member and also to prevent said drawer from being moved close enough to said closed position which would cause said latching mechanism to latch said drawer to said frame.

2. The drawer assembly as claimed in claim 1 in which said support means includes a projection which extends from said front panel towards said locking arm when said locking arm is moved to said locking position.

3. The drawer assembly as claimed in claim 2 in which said key lock includes a lock retainer for securing said key lock on said drawer and said projection is part of said lock retainer, and in which said abutment member is dimensioned to prevent said drawer from being moved to said closed position when said locking arm is inadvertently placed in said locking position.

4. An assembly for preventing a cash drawer release mechanism from jamming in a lockout status comprising:

a frame;

a cash drawer having a front panel;

mounting means for mounting said cash drawer for movement between open and closed positions relative to said frame;

a key lock mounted in said cash drawer, with said key lock having a locking arm moveable between locking and unlocking positions by a key associated with said key lock; and a projection member positioned on said front panel and aligned with said locking arm when said locking arm is in said locking position to prevent said locking arm from being bent towards said front panel and also to prevent said cash drawer from being moved to said closed position.

5. The assembly as claimed in claim 4 in which said key lock includes a metal retainer clip for retaining said key lock on said cash drawer, and said projection member is located on said retainer clip.

6. The assembly as claimed in claim 5 in which said metal retainer clip has a stiffening rib thereon to provide rigidity for said metal retainer clip.

* * * * *